United States Patent [19]

Perrine

[11] 4,126,079

[45] Nov. 21, 1978

[54] BOLT ACTUATING MECHANISM USEABLE WITH FLOATING FIRING PIN

[76] Inventor: Walter E. Perrine, P.O. Box 621, Elko, Nev. 89801

[21] Appl. No.: 829,791

[22] Filed: Sep. 1, 1977

[51] Int. Cl.[2] ..... F41D 11/06

[52] U.S. Cl. ..... 89/190; 42/69 A

[58] Field of Search ..... 89/168, 176, 180, 190

[56] References Cited

U.S. PATENT DOCUMENTS

| | | | |
|---|---|---|---|
| 915,087 | 3/1909 | Flyberg | 89/176 |
| 2,741,950 | 4/1956 | Smith | 89/168 |

*Primary Examiner*—Stephen C. Bentley

*Attorney, Agent, or Firm*—Warren F. B. Lindsley

[57] ABSTRACT

A gun employing improved bolt design and movement control to reduce recoil, facilitate loading and ejecting of the shells and employable with a floating firing pin.

18 Claims, 7 Drawing Figures

BOLT ACTUATING MECHANISM USEABLE WITH FLOATING FIRING PIN

BACKGROUND OF THE INVENTION

This invention relates to weapons and more particularly to a control means employing a floating firing pin that is biased against the shell by release of the bolt under pressure and returns under recoil to its floating position aiding in combination with the recoil springs the absorbtion of the recoil forces.

FIELD OF THE INVENTION

This invention is particularly directed to weapons such as rifles and pistols wherein a bolt extending means is tripped from a locked position when the gun is fired and configured to reduce the weight of the moving parts of the weapon located above the hands of the user thereby substantially reducing recoil of the weapon.

DESCRIPTION OF THE PRIOR ART

Heretofore, the majority of all weapons of this class have been toggle actuated causing their toggle links to recede into the handle of the gun when fired to offset the effects of firing recoil and are biased toward their locked position by a spring means bearing in a given area on the toggle.

Applicant's U.S. Pats. Nos. 3,630,119; 3,661,049; 3,709,091; 3,732,779; 3,748,961 and 3,783,739 are the closest prior art known but all of these patents disclose toggle action weapons and are therefore not anticipations of the invention claimed herein.

Since the largest contributor to the forces of recoil in toggle action weapons are the moving parts of the weapon arranged above the hands of the user, it is necessary to reduce this weight if recoil of the weapon is to be further reduced and more effectively controlled. Accordingly, the bolt design of the prior art and its spring control means arranged above the trigger hand of the user must be modified or changed.

SUMMARY OF THE INVENTION

In accordance with the invention claimed, a new and improved mechanism employing a novel bolt firing pin configuration and controls therefor is disclosed which can be used effectively to absorb the effects of the shell explosive forces in weapons such as rifles and pistols.

The new and improved weapons employing such a mechanism utilize gun barrel pressure to drive their bolts and associated mechanism from their at rest positions to their tripped positions. At the time this happens, the bullet has left the barrel of the gun and the residual pressure in the gun causes the bolt and its controlling mechanism to move to their fully retracted positions in the handle of the weapons. Recoil springs in the gun reacting on the bolt return the bolt to a predetermined position for locking in place.

It is, therefore, one object of this invention to provide a new and improved hand held weapon in which gas pressure generated in a gun barrel causes the bolt controlling gun mechanism to recede to a retracted position in the handle of the weapon.

Another object of this invention is to provide an improved weapon in which biasing forces acting on the firing pin aid in absorbing recoil.

A still further object of this invention is to provide an improved weapon in which the bolt upon release is free of the drag of any recoil restraints.

A still further object of this invention is to provide an improved weapon in which the bolt is held in weapon firing position and released by a single link retracting into the handle of the weapon.

A still further object of this invention is to provide an improved weapon employing a link the contour of which cooperates with a part of the bolt to provide a means for guiding it into the handle of the weapon.

A still further object of this invention is to provide an improved weapon employing one or more braking means for controlling the recoil action of its bolt mechanism.

A still further object of this invention is to provide a bolt in a weapon that is dynamically balanced to accomplish a smooth, consistent and continuous pressure throughout the movement of the bolt after tripping in which the line of force from the moving parts is directed to the palm of the hand, thereby virtually eliminating all noticeable recoil.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWING

The present invention may be more readily described by reference to the accompanying drawings in which.

DESCRIPTION OF THE PREFERRED EMBODIMENT

Figures 1, 1A, 2:
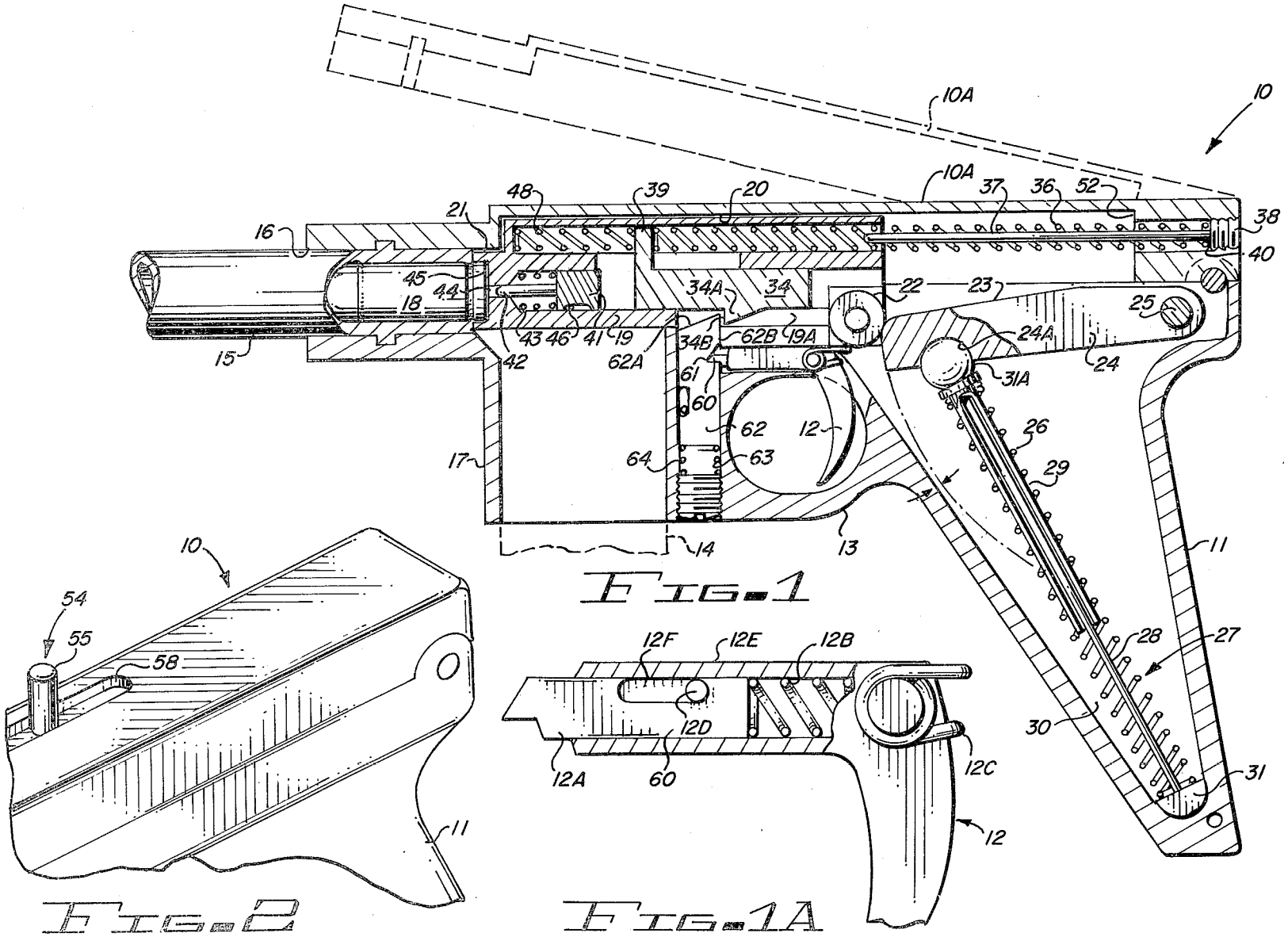
FIG. 1 is a partial cross-sectional view of a gas operated weapon with its link operating mechanism in position prior to firing and embodying the invention.
FIG. 1A is a partial enlarged view of the trigger mechanism showing more detail of its pin structure.
FIG. 2 is a partial enlarged view of a modification of the end of the weapon shown in FIG. 1 employing a manual bolt actuating means.

Referring more particularly to the drawing by characters of reference, FIG. 1 shows an example of one embodiment of this invention illustrating a partial view of a pistol having a frame 10, handle 11, trigger 12 with trigger guard 13 and a bullet magazine 14. A demountable adjustably positioned barrel 15 is received in a bore 16 in the front end of frame 10.

The bullet magazine 14 is demountably secured by the usual releasable latch in a guide sleeve 17 of frame 10 to feed the bullets 18 into insertion and firing position by a bolt 19 which moves on guiding surfaces 20 in frame 10 into an aligning aperture 21 in the rear end of barrel 15. The rear end of bolt 19 is provided with a roller or cam rider 22 mounted for rotation over a cam surface 23 of a link 24 pivotally connected by pin 25 to frame 10 of the weapon. Normally, when bullet 18 has been loaded in the barrel in firing position, line 24 is aligned, as shown in FIG. 1, at which time the longitudinal axis of line 24 is at an angle slightly below a line between the axes of roller 22 and pin 25.

A compression spring 26 carried on a telescoping push rod 27 comprising two tubular parts 28 and 29 is slidingly supported in a clearance hole 30 in handle 11 of the weapon. A dome shaped head 31A is provided at the free end of part 29 of rod 27 to bear against the free end of link 24 in a groove 24A or indentation having a curvature similar to the engaging part of head 31A, as shown. The compression spring 26 operates between a cup shaped head 31 positioned in a similarly shaped end of opening 30 in handle 11 and the dome shaped head 31A of part 29 of rod 27 to normally yieldingly hold surface 23 of link 24 against the knee of the cam rider 22 in the firing position of the gun. The link is tripped from its firing position by gas pressure from the gun barrel when the gun is fired.

Figure 4:
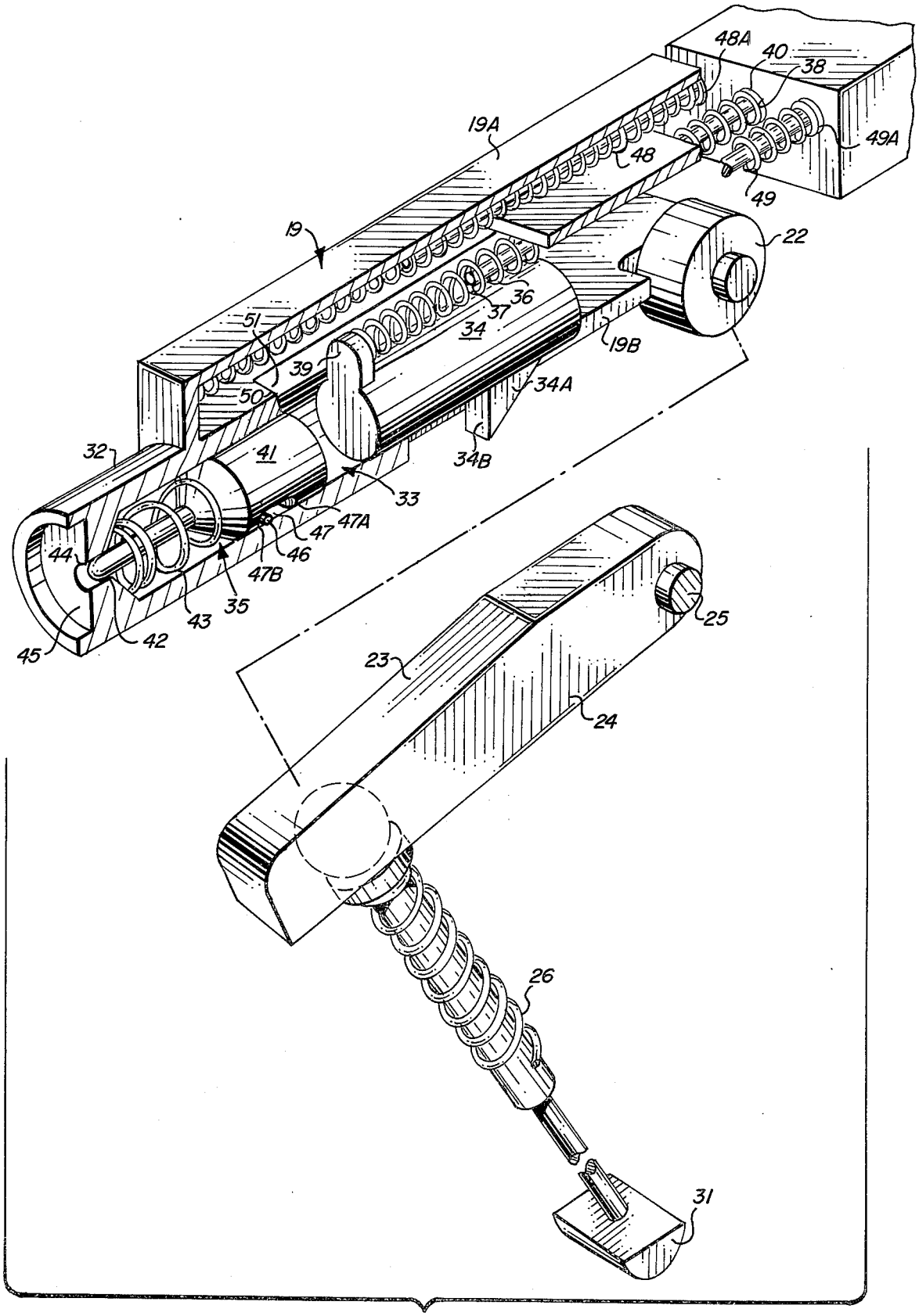
FIG. 4 is an enlarged partial exploded perspective view of the parts of the gas operated weapon shown in FIG. 1.

As noted from FIGS. 1 and 4 of the drawings, bolt 19 has been modified to differ from the prior art configurations by providing the normal cylindrical bolt configuration with a flat surface on its top which is guided by surface 20 forming a part of the inside periphery of the hinged top 10A of frame 10 of the weapon and a slotted opening 19C extending longitudinally of its lower cylindrical surface.

More particularly, the bolt comprises an elongated hollow tubular member having a cylindrical end 32 and defining a first cylindrical passageway or bore 33 for containing a cylindrical striker 34 and separate cylindrical firing pin assembly 35 both arranged in axial alignment in bore 33 for movement at times independently of bolt 19.

Striker 34 has an integral triangularly shaped fin 34A extending outwardly thereof into slotted opening 19A of bolt 19 for engaging with a link 62 hereinafter more fully described and is biased toward the firing pin assembly 35 by a compression spring 36 arranged around a guide rod 37 the fixed end of which is threadedly attached to a bore 38 in the rear of the frame of the weapon as shown in FIG. 1. This compression spring 36 is arranged to extend between a flange 39 attached to the front end of striker 34 and the base 40 of rod 37.

The firing pin assembly 35 is axially aligned with striker 34 for axial engagement therewith and comprises a cylindrical body 41 having an integrally mounted pin 42 extending axially therefrom directed toward the barrel 15 of the weapon. A coil spring 43 is loosely mounted around the firing pin 42 as shown in FIG. 4. The firing pin 42 is arranged to protrude into a guiding bore 44 in end 45 of bolt 19. The longitudinal movement of the firing pin assembly 35 is limited by a pin 46 which is arranged to extend from frame 10 into a slot 47 in the cylindrical body 41 of the firing pin assembly laterally of its longitudinal axis. The distance between ends 47A and 47B of the slot determine the path of travel of the firing pin assembly relative to pin 46 and is of sufficient length to permit the pin of the firing pin assembly to be moved by the striker into physical contact with the shell or bullet in the barrel of the weapon.

As noted from FIG. 1 of the drawing, bolt 19 is provided with the cylindrically shaped end 32 for fitting into a corresponding shaped opening in barrel 15 of the weapon. This change facilitates the action of loading and ejecting shells of the bullets into the barrel of the gun thereby increasing its efficiency and reducing the possibilities of misfiring tremendously since the entire barrel of the gun becomes a guiding surface of the bolt thereby eliminating jamming of the weapon.

As shown in the drawings of the prior art, as exemplified by the applicant's U.S. Pat. No. 3,630,119, compression springs have been arranged between a protruding lug of the bolt and a ridge formed in a bore defined by the frame and clamp of the weapon.

At the time the bullet of U.S. Pat. No. 3,630,119 is fired and leaves the barrel and is on its way to its target, residual pressure existing in a chamber of this weapon will drive its bolt backwards with sufficient force to complete the travel of its toggle mechanism sufficiently to move the center pin of the toggle and force it to complete its downward travel to its lowest point down inside the handle of the gun against the bias of its compression spring shown in FIG. 2 of this patent.

As disclosed herein bolt 19 comprises a hollow elongated portion 19A formed integral with the portion 19B thereof and houses the striker 34 and firing pin assembly 35. Portion 19A of the bolt contains a pair of juxtapositioned compression springs 48 and 49 one arranged on each side of spring 36. Each of springs 48 and 49 are seated in bores 48A, 49A formed in the back end of the frame of the weapon and extend toward the front end of the frame in the hollow interior of portion 19A of the bolt.

These springs 48 and 49 act on the bolt in the same manner as discussed above for the toggle action weapons referred to.

The inertia of the rearward action of the bolt compresses the recoil compression spring 48 and 49 as well as spring 36 after edge 50 of a slot 51 of bolt 19 engages flange 39 of striker 34 and continues then to compress all three springs until the end of the bolt engages a stop surface 52 of the frame of the weapon. When striker 34 is moved rearwardly in the frame of the weapon, its fin 34A slides over the rearwardly sloped top surface 62A of link 62, pushing it downwardly under the biasing effect of its spring 64. The bolt and toggle are then returned to their original positions by the stored up energy in these three springs with the surface 34B of the fin 34A engaging and being held in locked position by surface 62B of link 62. This completes the firing cycle and prepares the gun for the second firing having picked up an additional bullet from the clip magazine and placed it in the chamber when the bolt returned to its original position by a well known conventional mechanism.

In order to trip link 24 to lead the first bullet into the gun, a manual lever 54, as shown in FIG. 2, may be provided on the gun shown in FIG. 1 which when pulled back on by the operator causes it to trip or move link 24 downwardly enough to allow the operator to move bolt 19 backwardly sufficiently to permit a bullet 18 from the clip magazine 14 to enter the chamber of the gun for the first firing action.

The manual lever 54 extends laterally from the bolt of the weapon outwardly of frame 10 in a longitudinal extending slot 58 of frame 10 of the weapon or gun.

When the weapon is fired by applying rearward pressure on trigger 13, a pin 60 biased outwardly thereof by a spring 12B a predetermined distance which distance is controlled by a pin 120 attached to the housing 12E of the trigger and extending into a slot 12F, causes its tip 12A to extend outwardly thereof into a slot 61 of link 62 housed in a cylindrical opening 63 of frame 10. This action moves link 62 downwardly, as shown in FIG. 1, away from surface 34B of fin 34A of striker 34 under the tension of spring 64 releasing striker 34 and bolt 19 which causes both of them to move forward under the action of springs 48 and 49 to fire the weapon. When striker 34 and bolt 19 move forwardly, striker 34 engages the rear end of the firing pin assembly 41 driving it forwardly and its pin 42 into engagement with the firing end of bullet 18. Engagement of pin 42 with the bullet causing it to explode in the usual manner. After pin 42 engages and fires bullet 18, the force of the explosion drives the firing pin assembly backwardly toward the handle of the weapon if it had not already been moved backwardly in the weapon under the action of its spring 43. It should be noted that spring 43 was compressed during the forward movement and engagement of pin 42 with the bullet 18.

This forward movement of bolt 19 is sequentially reversed by the well known explosive forces of the weapon as mentioned above which reverse movement compresses springs 48 and 49 and sequentially spring 36 to absorb the reactive forces of the exploding bullet. During the backward or reverse movement of bolt 19, fin 34A of striker 34 moves over the surface 62A of link 62 driving it downwardly and cam rider 22 moves over surface 23 of line 24.

Figure 3A:
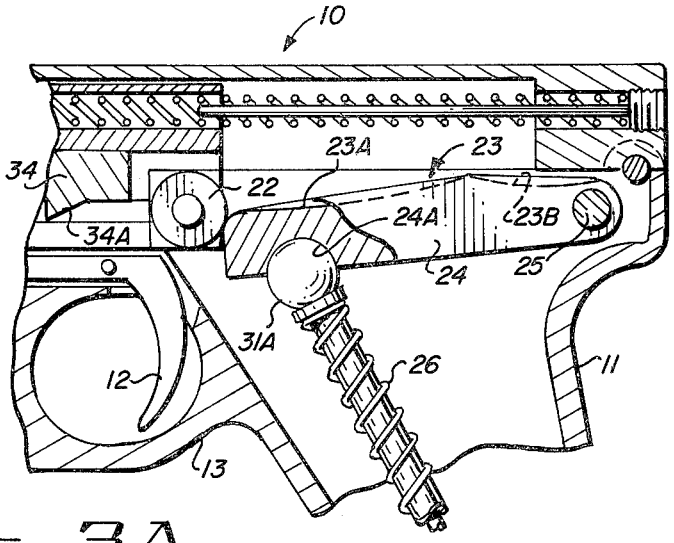
FIG. 3A, 3B and 3C are enlarged partial cross-sectional sequential views of various positions of the link and bolt mechanism during a gun firing operation.
Figure 3B:
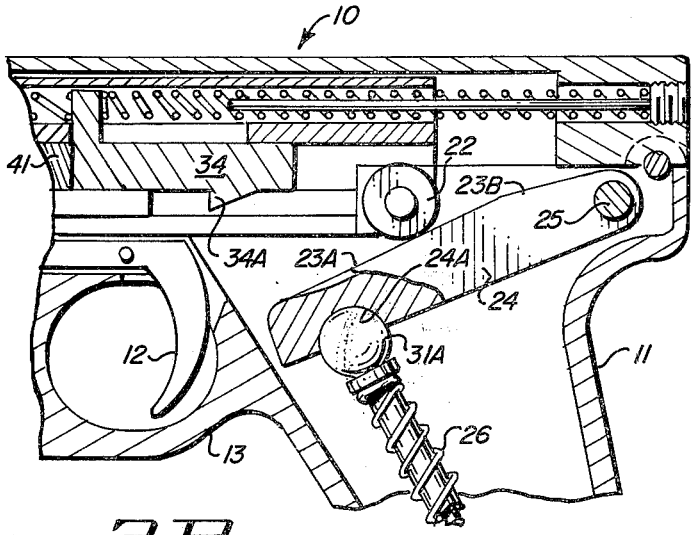
Figure 3C:
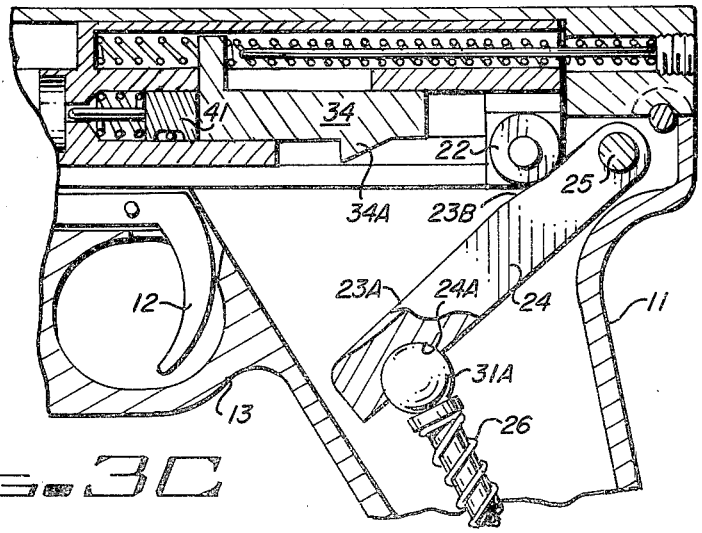

As evident from FIGS. 3A-3C as bolt 19 moves backwardly in frame 10 under the explosive forces of the bullet toward the rear end thereof, cam rider 22 moves over the surface 23 thereof forcing the free end of link 24 to move into the handle 11 of the weapon compressing spring 26.

The cam surface 23 of link 24 is conformed in any desired way to provide a predetermined time delay of the movement of the cam rider therealong before the end of the bolt reaches the stop surface 50 of frame 10.

As shown in FIGS. 3A-3C, the cam surface 23 may comprise two angularly positioned straight lined surfaces 23A and 23B but either of these surfaces may be contoured to form concave configurations 23A' and 23B' such as shown by dash lines in FIG. 3A to influence such as increase the time of movement and force necessary to drive cam rider 22 along surface 23 of link 24.

It should be noted that the disclosed novel gun system or apparatus reduces the distance between the trigger hand and the centerline of the bolt of the gun from that used in the prior art structures.

Heretofore, springs placed in the weapon to bias the toggle into its extended position had difficulty in placing the toggle and the bullet in the magazine in an identical position each time the weapon was fired. If a spring was positioned in the gun so as to be longitudinally arranged with the bolt of the weapon, the spring was then capable of driving the bullet forward into the chamber of the gun hard enough to seat it properly but it was not in a favorable position for absorbing recoil of the weapon or to aid in positioning the toggle in its properly extended position each and every cycle of gun actuation. Thus, if only a single spring was used longitudinally of the toggle mechanism, the toggle whether it was an under-center or over-center mechanism usually sagged a bit and if there was any friction in the operation of the moving parts, the sag prevented the bullet from being seated identically in the same position each time. Springs mounted to operate on the knee of the toggle arranged transversely to the longitudinal axis of the toggle failed also to seat the bullet each and every time and particularly were not in the most favorable position for absorbing recoil of the exploding shell.

Therefore, it is necessary to modify the bolt as disclosed hereto to operate in conjunction and combination with link 24 to obtain a dynamic balance operating system to absorb the recoil of the exploding shell as well as control the operation of the collapsing and extending action of the link mechanism.

As noted from the drawings bolt 19 is free to move under the action of springs 48 and 49. It has no mechanical connection to the tripping mechanism comprising link 24 and its controlling mechanism. After a firing sequence and return of bolt 19 to its forward position in the frame of the weapon, spring 26 moves and maintains link 24 and its surface at the free end of the link against cam rider 22 to hold and or lock the bolt in its extended, i.e., at rest position.

Thus, the prior art drag on the bolt has been eliminated by the disclosed design.

A further benefit of the claimed weapon is the feature of the floating firing pin assembly 35. Although this firing pin assembly may be eliminated from the weapon configuration and still fall within the scope of this disclosure, it provides, if utilized, a controlled movement of the pin against the end of the bullet for firing thereof. Since this pin assembly is not in mechanical connection with the striker 34 or the bolt 19, its longitudinal movement can not be affected by any distortion of the bolt movement caused in the prior art structures by the mechanical connection of the bolt to the controlling toggle mechanisms.

Heretofore, in weapons of the type disclosed, the toggle mechanism acted as a locking device and when collapsed, the recoil had to be absorbed by the bolt as it struck an abutting surface at the rear of the weapon. The bolt would come to a dead stop at the rear of the weapon thereby transmitting the recoil of the exploding shell to the holder of the weapon. When using high recoil shells, applicant has applied a braking system for the bolt which is effective without adding undesirable weight to the moving recoil control system found necessary in the prior art.

Thus, in accordance with the teachings of this invention, when the weapon is fired the two spring 48 and 49 initially are compressed with the sequential compression of spring 36. Upon the compression spring 36 all three springs exert pressure on the bolt with the striker remaining in contact with the bolt and moving rearwardly therewith. When the bolt returns to its forward cocked position in the frame of the weapon the striker may move forwardly independently of the bolt and comes to rest in its track in the bolt uneffective by the biasing effect of springs 48 and 49.

Although but a few embodiments of the invention have been shown and claimed, it will be apparent to those skilled in the art that various changes and modifications may be made therein without departing from the spirit of the invention or from the scope of the appended claims.

What is claimed is:

1. A bolt action weapon comprising:

a frame, a handle on said frame, a hollow barrel having a firing chamber, a bolt movable in said frame axially to and from the firing chamber of said barrel, said bolt having cam means on the end thereof opposite to said firing chamber for moving over a cam surface, an elongated link connected at one end to said frame and providing a cam surfaces along its length for engagement by said cam means, said link being movable into contact with said cam means to retain said bolt when it has been moved to said firing chamber, and a compression means mounted in said handle for biasing said link into contact with said bolt and for controlling the movement of said link as it collapses by causing its free end to swing downwardly away from said bolt into said handle.

2. The bolt action weapon set forth in claim 1 wherein:

said cam means comprises a rotatable member.

3. The bolt action weapon set forth in claim 1 wherein:

said cam surface is contoured to control the movement of said cam means thereover.

4. The bolt action weapon set forth in claim 1 wherein:

said cam surface is contoured to retard the movement of said cam surface thereover.

5. The bolt action weapon set forth in claim 1 wherein:

said compression means comprises a push rod pivotally engagable with said link at a point between its ends and slidably mounted in said handle for movement transversely of said bolt.

6. The bolt action weapon set forth in claim 5 in further combination with:

a spring means mounted on said push rod between a fixed point in said handle and a pivot on said compression means for compressing during movement of said link into said handle of said weapon, said spring biasing said link into bolt retaining position after a collapsing action of said link.

7. The bolt action weapon set forth in claim 1 in further combination with:

spring means mounted between a point on said frame and said bolt which compresses on movement of said bolt under a weapon firing action to absorb the explosive forces of the bullet and return said bolt to the firing chamber of said barrel after said absorbing action.

8. The bolt action weapon set forth in claim 7 wherein:

said spring means extends longitudinally of said weapon between a point at the rear of said frame and the end of a bore within said bolt.

9. The bolt action weapon set forth in claim 8 wherein:

said spring means comprises a pair of parallelly arranged springs one positioned on each side of said bolt.

10. The bolt action weapon set forth in claim 1 wherein:

said bolt comprises a striker means slidably mounted within a bore in said bolt and spring biased between a point on said frame and said striker means for aiding in absorbing the explosive recoil forces applied to said bolt.

11. The bolt action weapon set forth in claim 10 in further combination with:

a firing pin assembly slidably mounted in the bore of said bolt between said striker means and the firing chamber engaging end of said bolt, said assembly comprising a pin extending longitudinally of an axially outwardly of said bolt for engaging the bullet upon firing of said weapon.

12. The bolt action weapon set forth in claim 11 wherein:

said assembly comprises a spring mounted around said pin of said assembly which engages the end of said bore in said bolt when said bolt moves into said firing chamber an compresses thereby storing energy for quickly moving the pin of said assembly away from said firing chamber during movement of said bolt away from said firing chamber under the explosive forces of the bullet.

13. The bolt action weapon set forth in claim 12 wherein:

said assembly moves away from said firing chamber independently of the movement of said bolt away from said firing chamber.

14. The bolt action weapon set forth in claim 13 in further combination with:

first means mounted on said bolt for cooperating with a second means mounted on said assembly for controlling the limits of the axial movement of said assembly.

15. The bolt action weapon set forth in claim 14 wherein:

said first means comprises a pin and said second means comprises a groove in said assembly.

16. The bolt action weapon set forth in claim 1 wherein:

said bolt is slidably mounted in said frame independent of a fixed attachment to said frame.

17. The bolt action weapon set forth in claim 10 wherein:

said bolt is provided with a slot along a given length of said bore, said striker means comprises a fin extending into said slot, and trigger means mounted on said frame and comprises a link biased into said slot for cooperating with said fin to hold said bolt in a cocked position.

18. The bolt action weapon set forth in claim 17 wherein:

said fin moves over a surface of said link during a firing action of said weapon and is held together with said bolt in a cocked position by an interference engagement with said link, said link being withdrawn from said interference engagement upon predetermined pressure applied to a trigger of said trigger means.

* * * * *